US006615985B1

(12) United States Patent
Foreman

(10) Patent No.: US 6,615,985 B1
(45) Date of Patent: Sep. 9, 2003

(54) SLEEVE BOX

(75) Inventor: James R. Foreman, Bremen, IN (US)

(73) Assignee: Indiana Carton Company, Bremen, IN (US)

( * ) Notice: Subject to any disclaimer, the term of this patent is extended or adjusted under 35 U.S.C. 154(b) by 0 days.

(21) Appl. No.: 10/165,198

(22) Filed: Jun. 7, 2002

Related U.S. Application Data

(63) Continuation of application No. 29/148,759, filed on Sep. 26, 2001, now Pat. No. Des. 461,713.

(51) Int. Cl.[7] ..... B65D 73/00

(52) U.S. Cl. ..... 206/485; 256/194; 426/106; 229/87.08

(58) Field of Search ..... 206/162, 167, 206/169, 170, 194, 197, 434, 486, 490; 229/117.13, 117.14, 117.15, 87.08, 902, 903, 904, 905; 426/112, 115, 1.6, 107; 220/212, 366.1, 367.1

(56) References Cited

U.S. PATENT DOCUMENTS

| | | | | | |
|---|---|---|---|---|---|
| 1,981,647 | A | | 11/1934 | Johnson | |
| 2,222,211 | A | * | 11/1940 | Arneson | 206/170 |
| 2,284,290 | A | | 5/1942 | Marshall | |
| 2,304,683 | A | | 12/1942 | Finn | |
| 2,324,771 | A | | 7/1943 | Fiore | |
| 2,333,560 | A | * | 11/1943 | Gray | 206/168 |
| 2,335,022 | A | | 11/1943 | O'Reilly | |
| 2,375,631 | A | * | 5/1945 | De Villard | 206/194 |
| 3,166,235 | A | | 1/1965 | Schroeder | |
| 3,337,046 | A | | 8/1967 | Roy | |
| 3,363,747 | A | | 1/1968 | Nowak | |
| 3,498,449 | A | * | 3/1970 | Spery | 206/148 |
| 3,780,906 | A | * | 12/1973 | Katzenmeyer | 206/170 |
| 3,815,735 | A | | 6/1974 | Cucuo | |
| 3,923,236 | A | | 12/1975 | Calvert | |
| 4,013,798 | A | * | 3/1977 | Goltsos | 426/107 |
| 4,201,294 | A | | 5/1980 | Roccaforte | |
| 4,518,086 | A | | 5/1985 | Roccaforte | |
| 4,895,295 | A | * | 1/1990 | Montgomery et al. | 294/165 |
| 5,060,850 | A | | 10/1991 | Weaver | |
| 5,850,911 | A | * | 12/1998 | Pakzad | 206/217 |
| 5,957,276 | A | * | 9/1999 | Cutler et al. | 206/194 |
| 6,298,992 | B1 | * | 10/2001 | Tsao | 206/549 |
| 6,390,299 | B1 | * | 5/2002 | Mellon et al. | 206/485 |
| D461,713 | S | * | 8/2002 | Foreman | D9/434 |
| 6,559,431 | B2 | * | 5/2003 | Hopkins | 219/735 |

* cited by examiner

*Primary Examiner*—Shian Luong
(74) *Attorney, Agent, or Firm*—Botkin & Hall, LLP

(57) ABSTRACT

A sleeve box including a sleeve with a base, opposite sides, and a connecting handle over the base. At least one of the opposite sides of the sleeve has a locking tab. The sleeve box further includes a lower pan having an out turned flange forming a groove. An upper dome cover is fitted over the lower pan to form a food container. The sleeve is fitted around the food container with the locking tab fitted restrictively into the lower pan, thereby assisting to secure the food container within the sleeve. The sleeve has a vent aligned with a vent in the upper dome cover to allow heat to escape from the interior of the container.

3 Claims, 4 Drawing Sheets

SLEEVE BOX

CROSS-REFERENCE TO RELATED APPLICATION

This is a continuation of application Ser. No. 29/148,759 filed Sep. 26, 2001 now U.S. Pat. No. D461,713.

SUMMARY OF THE INVENTION

This invention relates to a food carrier in the form of a sleeve box which includes a food container and a surrounding sleeve.

The present invention provides a device for transporting food securely while limiting the user's exposure to heat should the food be heated. The container has a base and a removable dome cover. The sleeve includes a base, opposite sides and a connecting handle located over the base. At least one of the opposite sides of the sleeve has a locking tab. The container base has an out turned flange forming a groove. The sleeve is fitted around the food container with its locking tab fitted restrictively into the base groove, thereby assisting to secure the food container within the sleeve. A vent may be formed in the sleeve which is aligned with a vent in the dome cover to allow heat to escape from any heated food within the container.

Accordingly, it is an object of the present invention to provide for an improved food transport container.

Another object of this invention is to provide for a sleeve with a side locking tab which engages the container when the sleeve surrounds the container to minimize slippage of the container from the sleeve.

Yet another object of this invention is to provide for aligned vent openings in the sleeve and food container to allow heat to escape from the container.

Other objects of this invention will become apparent upon a reading of the following description.

BRIEF DESCRIPTION OF THE DRAWINGS

The above-mentioned and other features and advantages of this invention, and the manner of attaining them, will become more apparent and the invention will be better understood by reference to the following description of a preferred embodiment of the invention taken in conjunction with the accompanying drawings, wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to utilize the invention.

Figure 1:
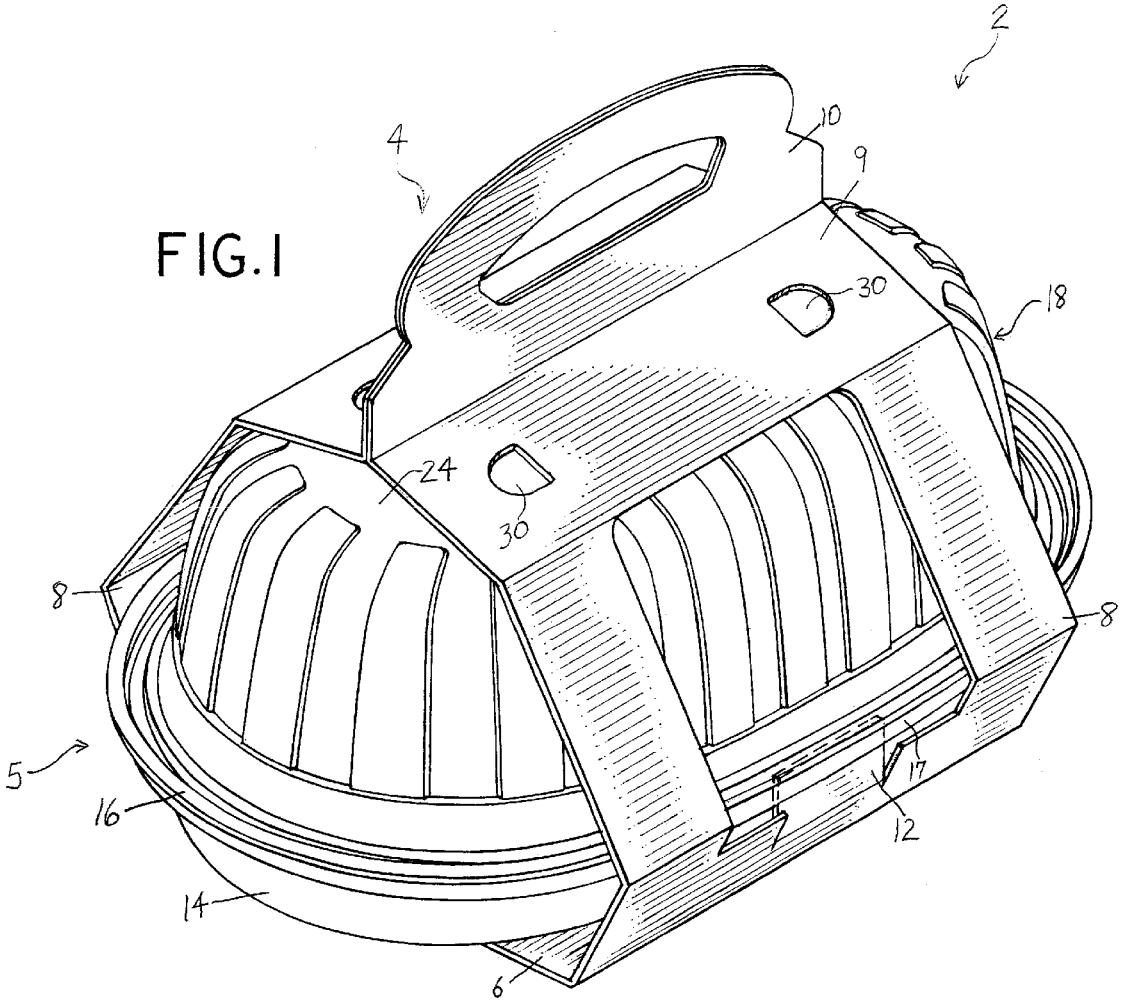
FIG. 1 is a top perspective view of the sleeve box of the present invention.
Figure 2:
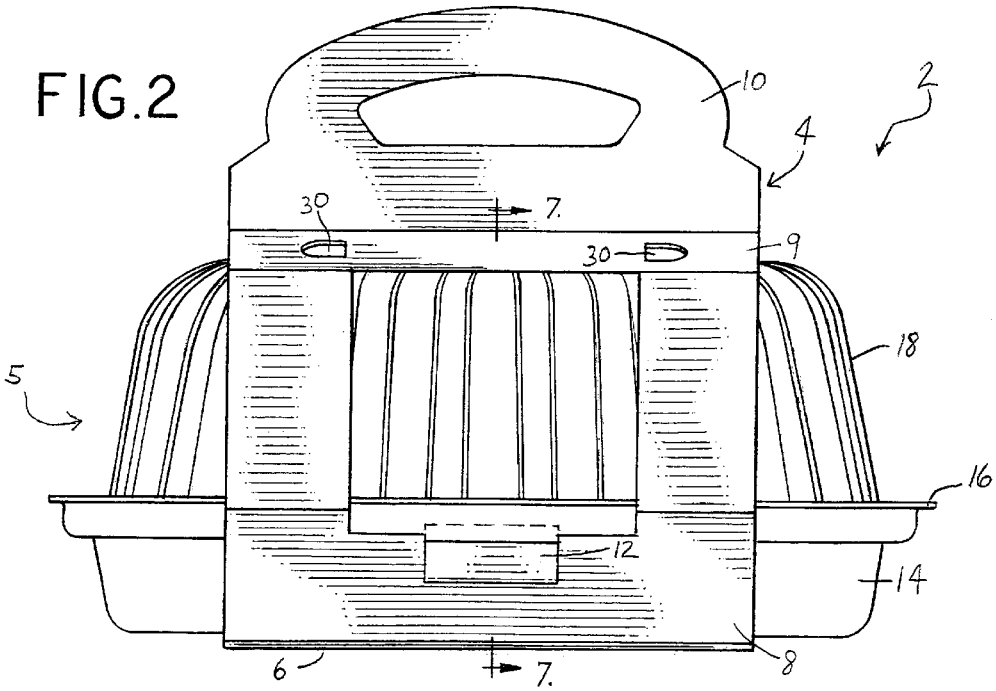
FIG. 2 is a side view of the sleeve box as seen from the left of FIG. 1.

Referring now to the drawings, and more particularly FIG. 1, sleeve box 2 of the present invention is shown as including a sleeve 4 and a container 5 having a lower pan 14 and an upper dome cover 18.

Sleeve 4 has a base 6, opposite sides 8 , and a top wall 9 terminating in a connecting handle 10. Preferably vents 30 are formed in the top wall 9. Each side 8 includes a locking tab 12. Lower pan 14 of the container has an outturned upper flange forming an outer upturned circumferential groove 16 and an inner downturned circumferential groove 17. Inner groove 17 provides a receiver for tabs 12 of sleeve 4 of the container. Dome cover 18 will generally include vents 26 in its top 24. Lower pan 14 and upper dome 18 when fitted together form the food container 5. Sleeve box 2 is formed when sleeve 4 surrounds food container 5.

To assemble sleeve box 2, food container 5 is first formed by placing dome cover 18 over and into outer groove 16 of lower pan 14. The food items (not shown) will have been previously placed in pan 14. Food container 5 is then slid endwise into sleeve 4, bringing dome cover vents 26 into alignment with sleeve vents 30, with the sleeve fitting constrictively about the container.

Figure 7:
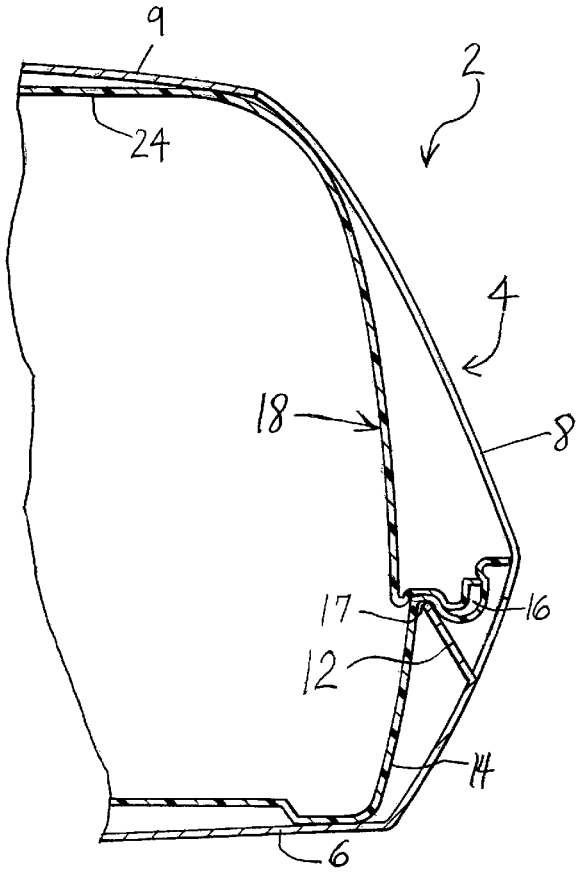
FIG. 7 is a partial sectional view taken along the line 7—7 of FIG. 2 showing the sleeve connected to container.

Locking tabs 12 are then flexed inwardly and snap fitted into inner groove 17 of lower pan 14, as seen in FIG. 7, into engagement with the pan to help secure sleeve 4 to food container 5. For this purpose, sleeve 4 is preferably formed of a semi-rigid, yet flexible material such as cardboard.

Figure 3:
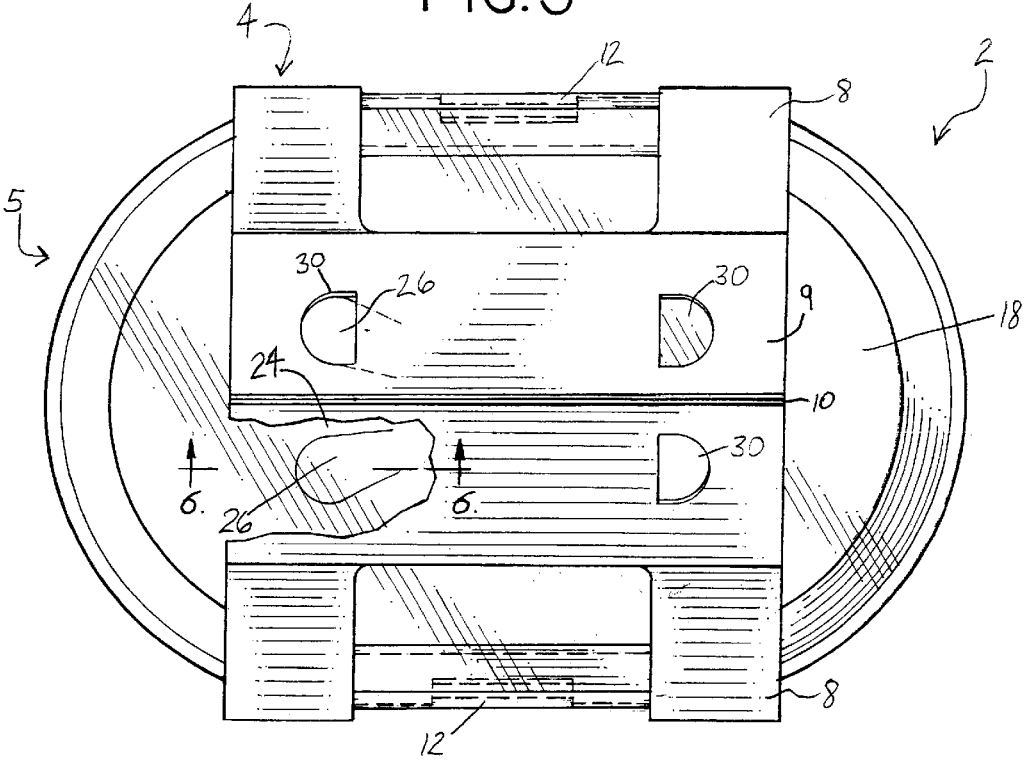
FIG. 3 is a top view of the sleeve box with portions of sleeve broken away for illustrative purposes.
Figure 4:
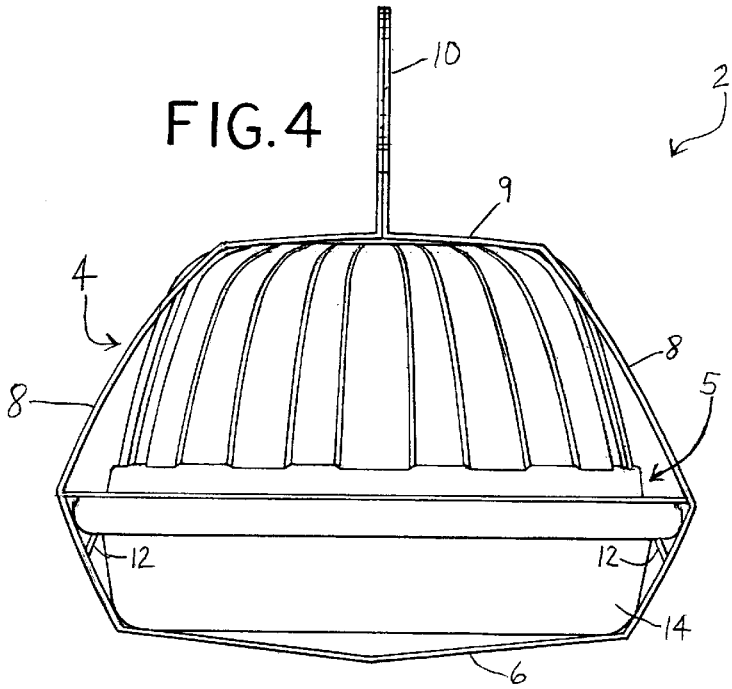
FIG. 4 is an end view of the sleeve box of this invention.
Figure 5:
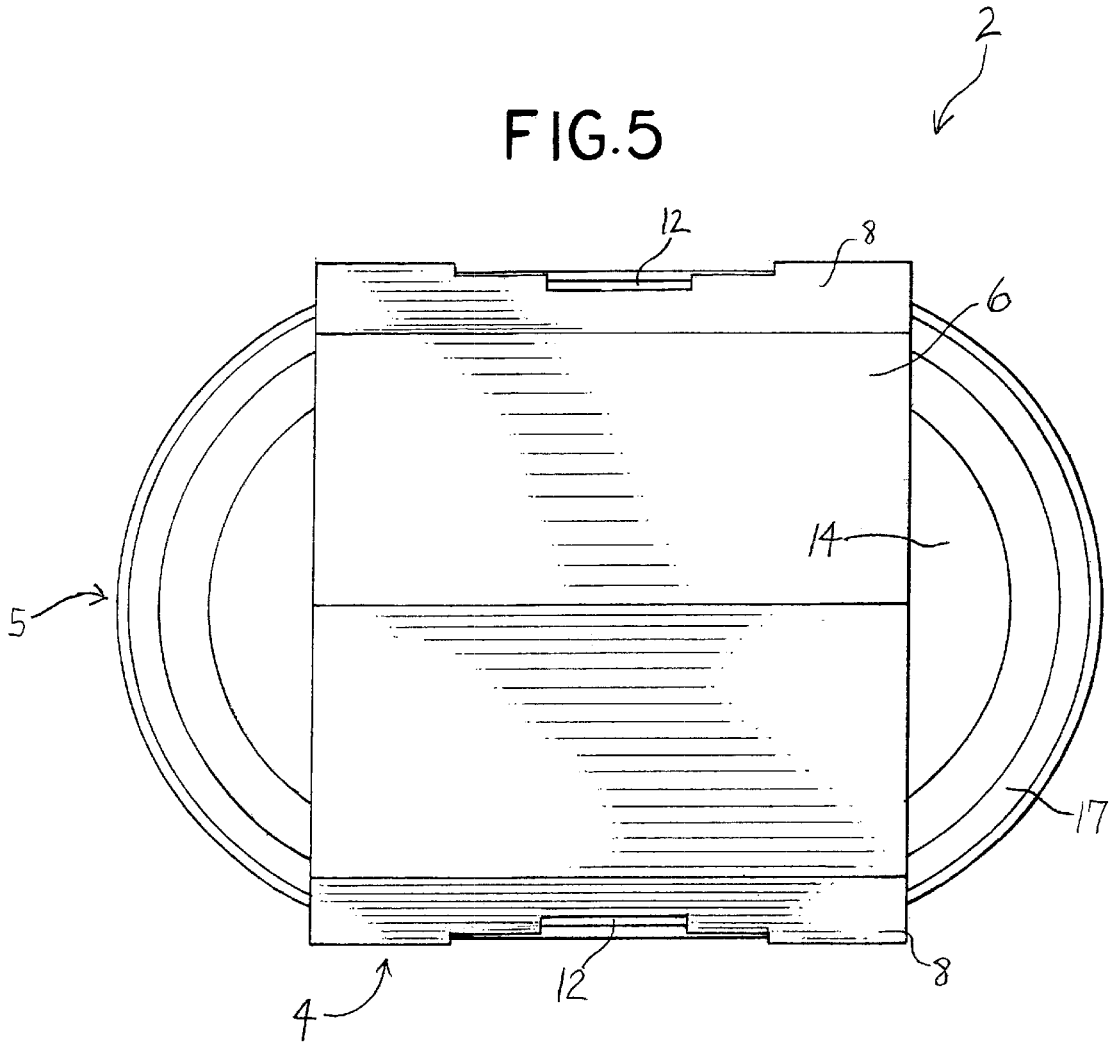
FIG. 5 is a bottom view of the sleeve box of this invention.
Figure 6:
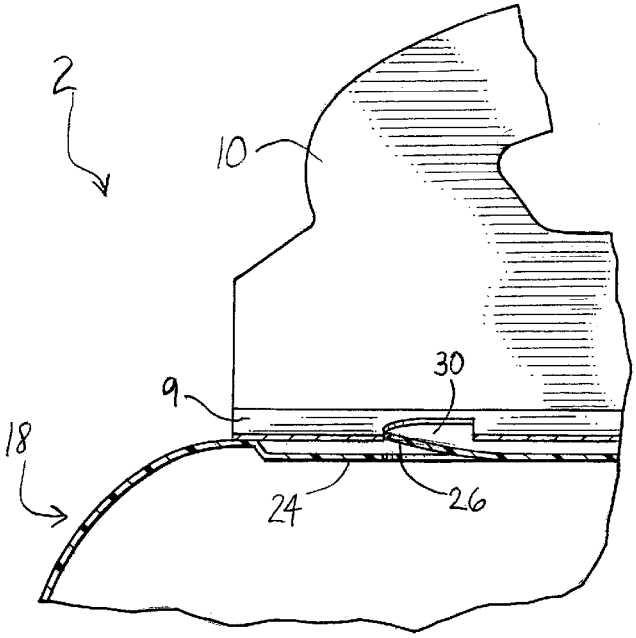
FIG. 6 is a fragmented sectional view taken along line 6—6 of FIG. 3 showing upper dome cover vent open.

Referring to FIGS. 3 and 6, dome cover vents 26 are shown aligned with sleeve vents 30. FIG. 6 shows upper dome cover vent 26 slightly flexed upwardly into an open position, due to the buildup of heat from the hot cooked food within container 5, allowing the heat to escape from sleeve box 2.

While this invention has been described as having a preferred design, the present invention can be further modified within the spirit and scope of this disclosure. Further, this application is intended to cover such departures from the present disclosure as come within known or customary practice in the art to which this invention pertains and which fall within the limits of the appended claims.

What is claimed is:

1. A sleeve box comprising a sleeve member having a base, opposite sides and connecting handle over said base, at least one of said opposite sides having a locking tab, a food container including a lower pan and a removable upper cover, said lower pan having an out turned flange forming a groove, said sleeve member fitted around said container with said locking tab fitted restrictively into said groove, thereby assisting to secure said container within said sleeve, said cover including a top, said top having vent therein, said sleeve member having a top wall connecting its said opposite sides, said sleeve member top wall having a vent formed therein, said sleeve member vent aligned with said cover vent to form means for allowing heat to escape from within said container.

2. The sleeve box of claim 1, wherein the other of said opposite sides has a locking tab, said second mentioned locking tab fitted restrictively into said groove, thereby assisting to secure said container within said sleeve member.

3. A sleeve box comprising a sleeve member having a base, opposite sides, a top wall connecting said opposite sides, and a connecting handle over said base, a food container including a lower pan and a removable upper cover, said sleeve member fitted around said container to secure said container within said sleeve, said cover including a top, said top having vent therein, said sleeve member top wall having a vent formed therein, said sleeve member vent aligned with said cover vent to form means for allowing heat to escape from within said container.

* * * * *